US005683071A

United States Patent [19]

Gibson et al.

[11] Patent Number: 5,683,071

[45] Date of Patent: Nov. 4, 1997

[54] APPARATUS FOR CONTROLLING SELECTIVELY ENGAGEABLE DETENTS IN A PILOT CONTROLLER

[75] Inventors: Marc D. Gibson, Greenville, S.C.; Michael E. Green, Cary; David G. Surridge, Knightdale, both of N.C.

[73] Assignee: Caterpillar Inc., Peoria, Ill.

[21] Appl. No.: 548,299

[22] Filed: Nov. 1, 1995

[51] Int. Cl.[6] ..... F15B 13/01

[52] U.S. Cl. ..... 251/32; 137/596.1; 137/624.27; 137/625.6

[58] Field of Search ..... 137/624.27, 625.6, 137/596.1; 251/32; 91/358 A

[56] References Cited

U.S. PATENT DOCUMENTS

| | | | |
|---|---|---|---|
| 3,759,485 | 9/1973 | Mills . | |
| 3,978,769 | 9/1976 | Day | 91/358 |
| 4,037,519 | 7/1977 | Miller et al. | 91/1 |
| 4,195,551 | 4/1980 | Schmiel | 91/358 |
| 4,220,074 | 9/1980 | Reip | 91/453 |
| 4,777,981 | 10/1988 | Petro | 137/636.2 |

*Primary Examiner*—Gerald A. Michalsky
*Attorney, Agent, or Firm*—Claude F. White; Diana L. Charlton

[57] ABSTRACT

A pilot hydraulic system controller including a pilot controller valve for controlling the flow of hydraulic fluid to actuate a primary hydraulic system valve, a pilot controller lockout valve, and a detent control circuit for selectively energizing a detent solenoid coil connected to said pilot controller valve, the detent control circuit include a switch means for selectively disabling the detent solenoid coil when the pilot controller lockout valve is actuated to hydraulically disable the pilot controller, so as to prevent the detent solenoid coil from acting upon the pilot controller valve when the pilot controller is hydraulically disabled.

26 Claims, 2 Drawing Sheets

APPARATUS FOR CONTROLLING SELECTIVELY ENGAGEABLE DETENTS IN A PILOT CONTROLLER

TECHNICAL FIELD

This invention relates generally to hydraulic systems, and more particularly to pilot operated hydraulic systems controllers in which a control lever is provided with at least one selectable detent position.

BACKGROUND ART

Hydraulic systems are commonly found on modern day equipment for the purpose of actuating and controlling the operation of implements and attachments provided on the equipment to perform the intended operative functions of the equipment. As is commonly known, hydraulic systems provide several advantages and enable the use of relatively larger, more capable equipment than that otherwise available, reducing crew sizes and man-hour requirements as well as lowering the expenses associated with maintenance and down-time. The use of hydraulic systems also substantially reduces operator fatigue and increases operator productivity substantially.

In the case of earth-moving or construction equipment, it is common to provide hydraulic systems having one or more cylinders responsive to the hydraulic fluid, each being controlled by a valve having one or more spools. With the passage of time, such equipment has become increasingly larger, employing correspondingly larger cylinders and valves, and also operating at substantially higher system pressure. In such larger equipment, a pilot hydraulic system controller is often provided. The pilot hydraulic system controller is typically a secondary hydraulic system operating at a substantially lower hydraulic fluid pressure and operatively connected to the spools of the valves controlling the primary operative hydraulic system. The pilot hydraulic system controller requires substantially less effort on the part of the operator and eliminates the need for extended mechanical linkages from the primary hydraulic system control valves to the operator control station so as to further improve the ease of maintenance of the equipment.

On the other hand, however, just as the primary hydraulic system requires a minimum pressure in order to operate the primary cylinders, the pilot hydraulic system also relies on a minimum hydraulic pressure in order to operate the spools of the primary hydraulic valves. In other words, when the hydraulic oil supply provided to the pilot hydraulic system controller is of inadequate pressure, movement of the pilot control lever will not cause a corresponding response in the primary hydraulic system control valve. This situation presents itself typically when the particular equipment is in a reduced power or idle condition. When in this condition, should the pilot control lever be moved to a selected position and retained in that position by a detent, the primary hydraulic system will not be actuated to respond to that change. However, when the equipment returns to a full power operation, the fluid pressure in the pilot controller will return to normal operating pressure, belatedly actuating the primary hydraulic system valve spool. Without operator intervention, the primary hydraulic system may then be actuated, causing an undesirable or unintended response of the primary hydraulic system.

The present invention is directed to overcoming one or more of the problems as set forth above.

Therefore, it is an object of the present invention to provide a pilot hydraulic system controller which responds to low pressure in the pilot hydraulic system.

It is another object of the present invention to provide such a pilot hydraulic system controller as will prevent inadvertent or unintended actuation of the primary hydraulic system.

It is a further object of the present invention to provide such a pilot hydraulic system controller as will be inexpensively and readily manufactured.

It is a further object of the present invention to provide such a pilot hydraulic system controller as will be easily and inexpensively maintained in operation.

It is yet another object of the present invention to provide such a pilot hydraulic system controller as will be readily and easily employed by the equipment operator, or as will otherwise obviate the need for operator intervention.

DISCLOSURE OF THE INVENTION

The subject invention is an improved pilot hydraulic system controller which includes means for selectively disengaging detent solenoids to prevent control lever detents from engaging the pilot control lever whenever the hydraulic pressure in the pilot hydraulic system controller is reduced or disabled and thereby insufficient to cause activation of the primary hydraulic system.

BEST MODE FOR CARRYING OUT THE INVENTION

Figure 1:
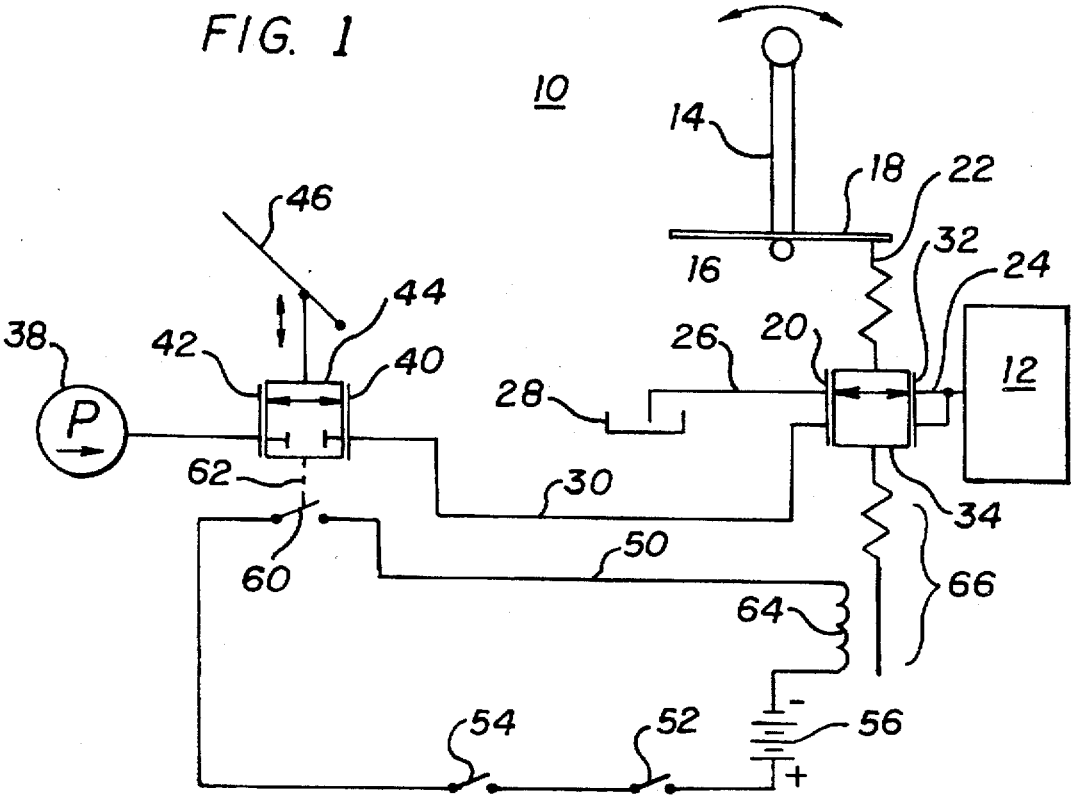
FIG. 1 shows a schematic representation of the preferred embodiment of the present invention.

An improved pilot hydraulic system controller apparatus, or pilot controller, for controlling primary hydraulic systems generally according to the present invention is shown in FIG. 1 in schematic representation and referred to with reference number 10.

The pilot controller 10 as described herein will be understood by those skilled in the relative art to be suitable for use in equipment having a primary hydraulic system 12 and further having an operators station (not shown) for permitting an operator to operate and control the relevant equipment. The description herein is not intended to refer or limit the use of the pilot controller 10 to any particular type of such equipment, and it is believed that those skilled in the relevant art will be able to readily and easily adapt the pilot controller 10 to such various equipment.

Turning then to FIG. 1, an operator responsive pilot control lever or actuator 14 is shown mounted on a lever pivot 16 in the operator station. The pilot control lever 14 further includes a pilot control lever actuator arm 18 which is operatively linked to a pilot controller valve 20. The linkage between the valve actuator arm 18 and the pilot controller valve 20 may be accomplished by a mechanical pilot actuator linkage 22, which may be either flexible or relatively rigid as required by the particular pilot controller 10. As shown, at least one pilot hydraulic connection 24 is provided to permit flow to the primary hydraulic system 12 from the pilot controller valve 20 or from the primary hydraulic system 12 to the pilot controller valve 20. As those skilled in the art will understand, the pilot hydraulic connection 24 typically connects operatively to a primary hydraulic system control valve (not shown) for the purpose of actuating that valve to cause or prevent a function of the primary hydraulic system 12. A second pilot hydraulic connection 26 selectively permits flow to the pilot controller reservoir 28, and a third pilot hydraulic connection, or pilot valve input line 30, permits flow of hydraulic fluid into the pilot controller valve 20.

The pilot controller valve 20 includes a valve body 32 in which a valve spool 34 is selectively operable between a first position and a second position. In the first position, flow is permitted from the primary hydraulic system 12 through the pilot controller valve 20 to the pilot controller reservoir 28. In the second position, flow is permitted through the pilot controller valve 20 to the primary hydraulic system 12. A hydraulic fluid supply or pump 38 is provided for supplying hydraulic fluid to the pilot valve input line 30.

A pilot lockout valve 40 is provided in the pilot valve input line 30 between the pump 38 and the pilot controller valve 20. This pilot lockout valve 40 may be a ball-type valve or a sliding gate-type valve. As shown herein, for simplicity, a sliding gate-type valve is described. The pilot lockout valve 40 includes a lockout valve body 42 in which a lockout valve spool 44 selectively operates between a first position and a second position. An operator responsive lockout valve actuator lever 46 is provided at the operator control station for permitting the operator to select the first position or the second position of the lockout valve spool 44. In the first position of the pilot lockout valve 40, flow is prevented from the pump 38 to the pilot valve input line 30, disabling the pilot controller 10, whereas, the pilot controller 10 is enabled when the pilot lockout valve spool 44 is placed in the second position to permit flow from the pump 38 through the pilot input line 30.

The pilot controller 10 further includes a detent control circuit 50 for controlling a selectively engageable detent. According to the preferred embodiment, the detent control circuit 50 includes a first switch 52 which is preferably mechanically or electrically interlocked with the ignition circuitry of the equipment on which the pilot controller 10 is used so that the detent control circuit 50 is enabled when the equipment on which the pilot controller 10 is used, including the primary hydraulic system, is otherwise operable. Likewise, an operator responsive second switch 54 is provided in the detent control circuit 50, being placed in the operator station so as to permit the operator to selectively enable or disable the detent control circuit 50. A voltage source 56 such as a battery is provided to power the detent control circuit 50. As those skilled in the art will recognize, the battery 56 may be the primary battery of the equipment upon which the pilot controller 10 is operated. The detent control circuit 50 further includes a detent lockout switch 60 which is linked by a lockout switch linkage 62 to the pilot lockout valve 40. According to the preferred embodiment, the lockout switch linkage 62 is operably connected mechanically to the pilot lockout valve spool 44 so as to actuate the lockout switch 60 between an open position and a closed position in conjunction with the actuation of the pilot lockout valve 40. That is, when the pilot lockout valve spool 44 is in the first position and the pilot controller 10 is hydraulically disabled, the detent lockout switch 60 is likewise open to disable the detent control circuit 50. When the pilot lockout valve spool 44 is actuated to the second position so as to enable hydraulic fluid flow in the input line 30, the detent lockout switch 60 is closed to enable the detent control circuit 50. Finally, the detent control circuit 50 includes a detent solenoid coil 64 which acts magnetically upon a detent linkage 66 which is mechanically connected to the pilot control valve spool 44 to act as a detent thereon.

In operation, the pilot hydraulic system controller 10 is operated by placing the first switch 52 in a closed position by operation of the ignition key assembly, the second switch 54 is operator selected to the closed position, so that the first switch 52 and the second switch 54 are operator selected to enable the detent control circuit 50. The pilot lockout valve actuator lever 46 is then actuated by the operator to move the pilot lockout valve spool 44 from the first position, wherein the detent lockout switch 60 is in the open position, to move the pilot lockout valve spool 44 to the second position and thereby complete the detent control circuit 50 and simultaneously enable hydraulically the pilot controller 10. When the detent control circuit 50 is thus enabled, current is provided by the battery through the first switch 52, the second switch 54, and the detent lockout switch 60 to generate a magnetic field in the solenoid coil 64 and act upon the detent linkage 66. When the operator moves the pilot control lever 14 and, through the valve actuator arm 18 and linkage spring 22 moves the pilot valve spool 34 to the second position, the magnetic field of the solenoid coil 64 acts upon the detent linkage 66 to retain the pilot valve spool 34 in the second position. The operator then may select to bring the pilot valve spool 34 to the first position by manual activation of the pilot control lever 14.

When the operator temporarily suspends operation of the equipment on which the pilot controller 10 is utilized, the operator may disable the pilot controller 10 by actuating the pilot lockout valve actuator lever 46 to the first position, disabling the pilot controller 10 by preventing hydraulic flow through the input line 30 and simultaneously disabling the detent control circuit 50 by mechanically opening the detent lockout switch 60 by the action of the lockout switch linkage 62. Therefore, when the pilot lockout valve 40 is actuated to the first position, the detent control circuit 50 prevents the flow of current and the generation of the magnetic field by the solenoid coil 64, thereby preventing the solenoid coil 64 from retaining the pilot valve spool 34 in the second position, even if the pilot control lever 14 is otherwise moved to actuate the pilot valve spool 34 to the second position.

There are alternative embodiments of the subject invention which may be devised within the scope and spirit of the description and following claims. It should be noted that when the same item or feature is shown in more than one embodiment, it will be labeled with the corresponding reference numeral to aid in the understanding of the subject invention, including only a suffix indicating the embodiment referred to. Furthermore, reference should be had to all of the Figures necessary to aid in the understanding of the specification even where a particular Figure is referred to, as all reference numerals are not displayed in all Figures in order to minimize confusion and aid in clarifying the subject invention.

Figure 2:
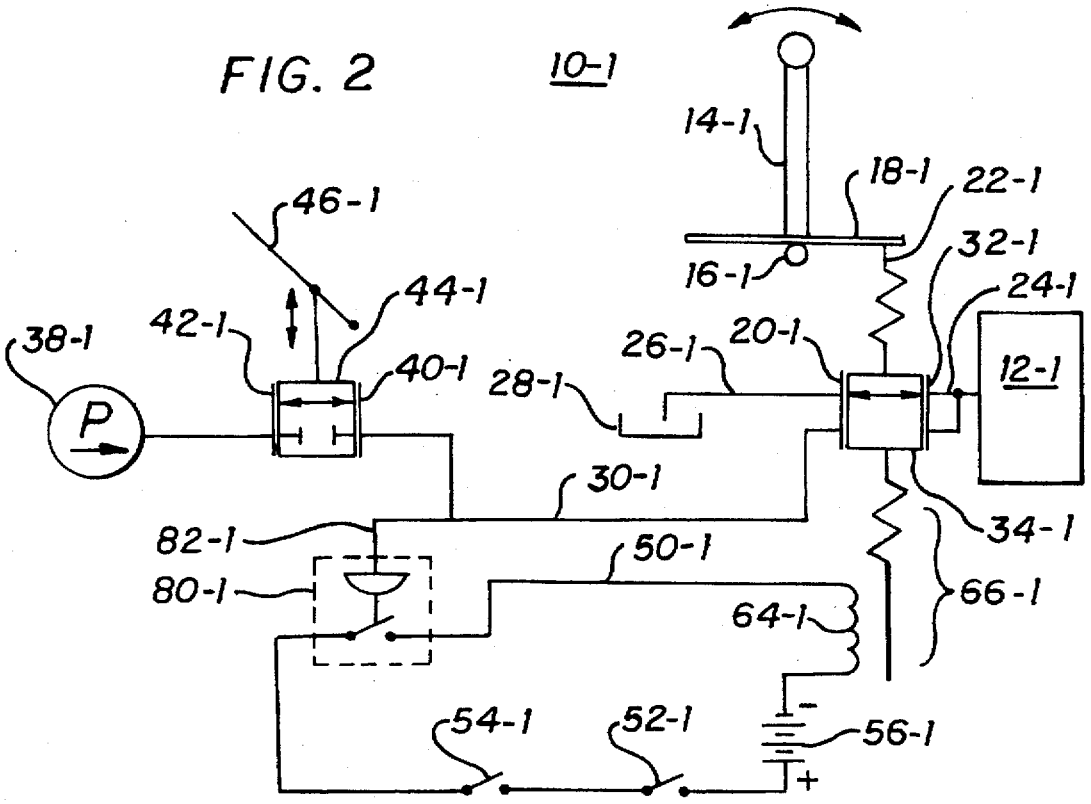
FIG. 2 shows a schematic representation of a first alternative embodiment of the present invention.

Turning then to FIG. 2, an alternative embodiment of the pilot controller 10-1 according to the subject invention is disclosed. In this first alternative embodiment, a pressure operated detent lockout switch 80-1 is provided to respond to the hydraulic pressure in the pilot valve input line 30-1. A pressure transmission line 82-1 branches from the pilot valve input line 30-1 between the pilot lockout valve 40-1 and the pilot controller valve 20-1 to transmit the hydraulic pressure in the pilot valve input line 30-1 to the pressure operated detent lockout switch 80-1. The pressure operated detent lockout switch 80-1 is responsive to the pressure in the pressure transmission line 82-1 so that a reduced pressure therein will cause the switch 80-1 to open and disable the detent control circuit 50-1.

In operation, therefore, whenever the hydraulic pressure in the pilot valve input line 30-1 is reduced below a selected level, the switch 80-1 will open and disable the detent control circuit so that the detent solenoid coil 64-1 will not operate. This will occur whether the decrease in pressure is due to activation of the pilot lockout valve 40-1 or due to insufficient hydraulic pressure in the supply from the pump 38-1. Conversely, whenever the pressure in the pilot valve input line 30-1 has reached a threshold pressure level sufficient to operate the pilot controller 10-1, for example, 320 p.s.i. in a system nominally operating at 400 to 450 p.s.i., the pressure operated detent lockout switch 80-1 will close to enable detent control circuit 50-1.

Figure 3:
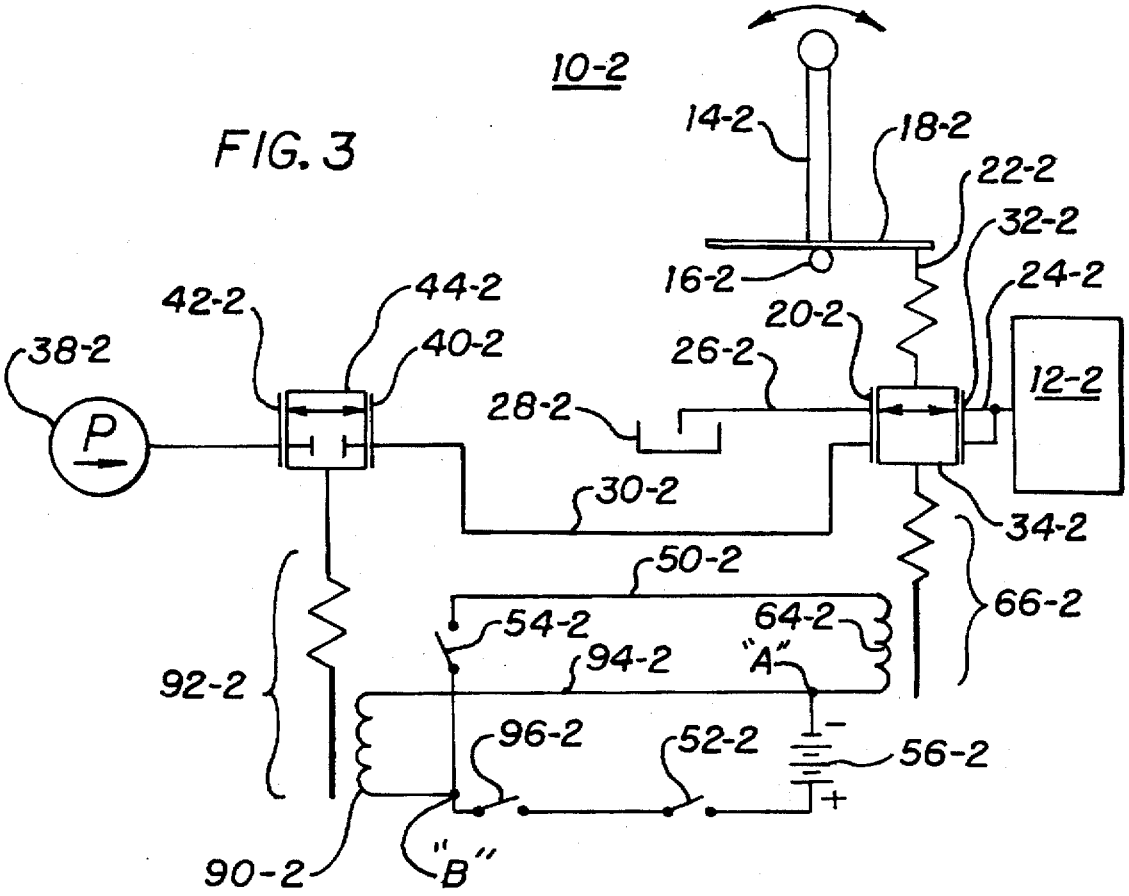
FIG. 3 shows a schematic representation of a second alternative embodiment of the present invention.

A second alternative embodiment of the pilot controller 10-2 is disclosed in FIG. 3. The detent control circuit 50-2 further includes a lockout solenoid coil 90-2 for selectively magnetically activating a lockout linkage 92-2 operably connected to the pilot lockout valve 40-2 to actuate the lockout valve spool 44-2 between the first position and the second position. The lockout solenoid coil 90-2 is in a lockout control circuit 94-2 connected at a point A between the pilot solenoid coil 64-2 and the battery 56-2 through the lockout solenoid coil 90-2 to a point B between the first switch 52-2 and the second switch 54-2. A lockout control switch 96-2 between the point B and the first switch 52-2 is provided to control both the lockout solenoid coil 90-2 and the detent solenoid coil 64-2.

In operation, the lockout control switch 96-2 is placed in the open position to disable the detent solenoid coil 64-2. When the lockout control switch 96-2 is in the open position, the lockout solenoid coil 90-2 is also de-energized, permitting the pilot lockout valve spool 44-2 to move to the flow-preventing position and thus lock hydraulically the pilot controller 10-2. Conversely, when the lockout control switch 96-2 is in the closed position, the lockout solenoid coil 90-2 is energized to move the pilot lockout valve spool 44-2 to the open position and thereby unlock hydraulically the pilot controller 10-2, simultaneously enabling the detent control circuit 50-2.

It can be seen that the subject invention, according to any of the foregoing embodiments, offers several advantages to the operator of the pilot controller 10, by improving feedback to the operator. Feedback to the operator as to the operation of the pilot controller 10 is substantially enhanced. When the pilot controller is hydraulically locked, movement of the pilot control lever 14 will not cause the lever 14 to be held by the detent solenoid coil 64 in an actuation position which the pilot controller 10 is not responding to. Therefore, the operator will not be misled as to the actuation of the primary hydraulic system. Furthermore, the pilot control lever 14 will not be detained so as to cause an unexpected actuation of the primary hydraulic system upon unlocking the pilot controller 10. In addition, the pilot controller 10 is inexpensive to manufacture and to maintain, and places no additional requirements upon the operator of the equipment.

Other aspects, objects and advantages of the subject invention can be obtained from a study of the drawings, the disclosure and the appended claims.

We claim:

1. A pilot hydraulic system controller apparatus for controlling a primary hydraulic system, the pilot controller comprised of:

a pilot controller valve connected to said primary hydraulic system for selectively permitting a flow of hydraulic fluid therebetween;

a pilot valve input line connected to said pilot controller valve for permitting a flow of hydraulic fluid thereto, said pilot valve input line including a pilot lockout valve for selectively preventing said flow of hydraulic fluid to the pilot controller valve;

a detent solenoid coil operably linked to said pilot controller valve for detaining said pilot controller valve in a selected position when said detent solenoid coil is energized;

a detent control circuit for selectively energizing said detent solenoid coil, said detent control circuit including a detent lockout switch, said detent lockout switch linked to said pilot lockout valve to energize said detent solenoid coil when said pilot lockout valve is in a flow permitting condition, and to de-energize said detent solenoid coil when said pilot lockout valve is in a flow preventing condition.

2. The pilot controller as set forth in claim 1 wherein said pilot controller valve further includes a pilot valve spool selectively operable between a first position and a second position.

3. The pilot controller as set forth in claim 2 wherein said pilot controller valve further includes a second hydraulic connection to a pilot controller reservoir for flow from said pilot controller valve when said pilot valve spool is in the first position.

4. The pilot controller as set forth in claim 3 wherein said pilot lockout valve further includes a pilot lockout valve spool selectively operable between a first position for preventing flow through the pilot valve input line and a second flow-permitting position.

5. The pilot controller as set forth in claim 4 wherein said pilot lockout valve further includes a lockout switch linkage operably connected to said detent lockout switch to actuate the detent lockout switch to an open position when the pilot lockout valve spool is in the first position for preventing flow through the pilot valve input line and to a closed position when said pilot lockout valve spool is in the second flow-permitting position.

6. The pilot controller as set forth in claim 5 wherein said detent control circuit further includes a first switch to enable the detent control circuit when said hydraulic system is enabled.

7. The pilot controller as set forth in claim 6 wherein said pilot controller valve further includes an operator responsive second switch to permit an operator to selectively disable said detent control circuit.

8. The pilot controller as set forth in claim 7 wherein said pilot controller valve further includes a detent linkage responsive to said detent solenoid coil.

9. The pilot controller as set forth in claim 8 wherein said pilot controller further includes a voltage source to power the detent control circuit.

10. The pilot controller as set forth in claim 9 wherein said pilot controller further includes an operator responsive pilot control lever.

11. The pilot controller as set forth in claim 10 wherein said pilot controller further includes a pilot actuator linkage for causing actuation of the pilot valve spool in response to the pilot control lever.

12. A pilot hydraulic system controller apparatus for controlling a primary hydraulic system, the pilot controller comprised of:

a pilot controller valve connected to said primary hydraulic system for selectively permitting a flow of hydraulic fluid therebetween, said pilot controller valve further including a pilot valve spool selectively operable between a first position and a second position;

an operator responsive pilot control lever;

a pilot actuator linkage for causing actuation of the pilot valve spool in response to the pilot control lever;

a pilot valve input line connected to said pilot controller valve for permitting a flow of hydraulic fluid thereto, said pilot valve input line including a pilot lockout valve for selectively preventing said flow of hydraulic fluid to the pilot controller valve, said pilot lockout valve further includes a pilot lockout valve spool selectively operable between a first position for preventing flow through the pilot valve input line and a second flow-permitting position;

a detent solenoid coil operably linked by a detent linkage responsive to said detent solenoid coil to said pilot controller valve, said detent solenoid coil detaining said pilot controller valve in a selected position when said detent solenoid coil is energized;

a detent control circuit for selectively energizing said detent solenoid coil, said detent control circuit including a detent lockout switch, said detent lockout switch operably connected by a lockout switch linkage to actuate the detent lockout switch to an open position when the pilot lockout valve spool is in the first position for preventing flow through the pilot valve input line and to a closed position when said pilot lockout valve spool is in the second flow-permitting position;

a first switch to enable the detent control circuit when said hydraulic system is enabled; and an operator responsive second switch to permit an operator to selectively disable said detent control circuit.

13. A pilot hydraulic system controller apparatus for controlling a primary hydraulic system, the pilot controller comprised of:

a pilot controller valve connected to said primary hydraulic system for selectively permitting a flow of hydraulic fluid therebetween;

a pilot valve input line connected to said pilot controller valve for permitting a flow of hydraulic fluid thereto, said pilot valve input line including a pilot lockout valve for selectively preventing said flow of hydraulic fluid to the pilot controller valve, said pilot lockout valve further includes a pilot lockout valve spool;

a lockout linkage operably connected to the pilot lockout valve to actuate the pilot lockout valve spool between a first position and a second position;

a detent solenoid coil operably linked to said pilot controller valve for detaining said pilot controller valve in a selected position when said detent solenoid coil is energized;

a detent control circuit for selectively energizing said detent solenoid coil, said detent control circuit including a lockout control circuit having an operator responsive detent lockout switch and a lockout solenoid coil, said lockout solenoid coil energized to activate said lockout linkage when said detent lockout switch is actuated to enable the detent solenoid coil, and de-energized when said detent lockout switch is actuated to disable the detent solenoid coil.

14. The pilot controller as set forth in claim 13 wherein said detent control circuit further includes a first switch to enable the detent control circuit when said hydraulic system is enabled.

15. The pilot controller as set forth in claim 14 wherein said pilot controller valve further includes an operator responsive second switch to permit an operator to selectively disable said detent control circuit.

16. The pilot controller as set forth in claim 15 wherein said pilot controller valve further includes a pilot valve spool selectively operable between a first position and a second position and a detent linkage responsive to said detent solenoid coil.

17. The pilot controller as set forth in claim 16 wherein said pilot controller further includes a voltage source to power the detent control circuit.

18. The pilot controller as set forth in claim 17 wherein said pilot controller further includes an operator responsive pilot control lever.

19. The pilot controller as set forth in claim 18 wherein said pilot controller further includes a pilot actuator linkage for causing actuation of the pilot valve spool in response to the pilot control lever.

20. A pilot hydraulic system controller apparatus for controlling a primary hydraulic system, the pilot controller comprised of:

a pilot controller valve connected to said primary hydraulic system for selectively permitting a flow of hydraulic fluid therebetween;

a pilot valve input line connected to said pilot controller valve for permitting a flow of hydraulic fluid thereto, said pilot valve input line including a pilot lockout valve for selectively preventing said flow of hydraulic fluid to the pilot controller valve;

a detent solenoid coil operably linked to said pilot controller valve for detaining said pilot controller valve in a selected position when said detent solenoid coil is energized;

a detent control circuit for selectively energizing said detent solenoid coil, said detent control circuit including a pressure operated detent lockout switch, said detent lockout switch enabling said detent solenoid circuit when said pilot lockout valve is in a flow permitting condition, and de-energizing said detent solenoid circuit when said pilot lockout valve is in a flow preventing condition.

21. The pilot controller as set forth in claim 20 wherein said detent control circuit further includes a first switch to enable the detent control circuit when said hydraulic system is enabled.

22. The pilot controller as set forth in claim 21 wherein said pilot controller valve further includes an operator responsive second switch to permit an operator to selectively disable said detent control circuit.

23. The pilot controller as set forth in claim 22 wherein said pilot controller valve further includes a pilot valve spool selectively operable between a first position and a second position and a detent linkage responsive to said detent solenoid coil.

24. The pilot controller as set forth in claim 23 wherein said pilot controller further includes a voltage source to power the detent control circuit.

25. The pilot controller as set forth in claim 24 wherein said pilot controller further includes an operator responsive pilot control lever.

26. The pilot controller as set forth in claim 25 wherein said pilot controller further includes a pilot actuator linkage for causing actuation of the pilot valve spool in response to the pilot control lever.

* * * * *